United States Patent [19]

Byström et al.

[11] Patent Number: 5,052,345

[45] Date of Patent: Oct. 1, 1991

[54] HEATING APPARATUS WITH A HEAT EXCHANGER

[75] Inventors: Kurt Byström, Erkiesberga, S-741 00 Knivsta; Lars E. Johansson, Sollentuna, both of Sweden

[73] Assignee: Kurt Byström, Erkesberga, Sweden

[21] Appl. No.: 476,458

[22] PCT Filed: Oct. 12, 1989

[86] PCT No.: PCT/SE89/00561

§ 371 Date: Aug. 2, 1990

§ 102(e) Date: Aug. 2, 1990

[87] PCT Pub. No.: WO90/04139

PCT Pub. Date: Apr. 19, 1990

[30] Foreign Application Priority Data

Oct. 13, 1988 [SE] Sweden ..... 8803657

[51] Int. Cl.[5] ..... F22B 33/00

[52] U.S. Cl. ..... 122/20 B; 122/7 R

[58] Field of Search ..... 122/20 B, 70 R; 126/365

[56] References Cited

U.S. PATENT DOCUMENTS

| | | | |
|---|---|---|---|
| 2,320,532 | 6/1943 | Munsters et al. . | |
| 4,251,028 | 2/1981 | Hizulai et al. | 122/20 B X |
| 4,275,687 | 6/1981 | Sasaki . | |
| 4,318,366 | 3/1982 | Tompkins | 122/20 B |
| 4,373,473 | 2/1983 | Grandmont | 122/20 B |

FOREIGN PATENT DOCUMENTS

| | | |
|---|---|---|
| 184820 | 9/1936 | Switzerland . |

*Primary Examiner*—Edward G. Favors

*Attorney, Agent, or Firm*—Witherspoon & Hargest

[57] ABSTRACT

A heating apparatus including a burner and a heat exchanger wherein the burner supplies a primary fluid and exhaust gas to the heat exchanger. Secondary fluid supplied to the heat exchanger is first heated within the heat exchanger by the primary fluid and then is further heated within the heat exchanger by the exhaust gas.

8 Claims, 2 Drawing Sheets

HEATING APPARATUS WITH A HEAT EXCHANGER

The present invention relates to heating apparatus, preferably such as are oil-fired, which include a heat exhanger, and which are intended for supplementing or replacing conventional heating installations, e.g. for small house boilers and the like.

As a result of increases in the price of oil, and since oil is occasionally a commodity difficult to obtain, it has become more and more desirable to obtain effective installations for heating purposes which are economical with regard to fuel and which also have a low price. This invention is described, per se, in connection with problems concerning one-family houses, but one skilled in the art will understand that the invention has many conceivable applications and is thus not restricted to this field.

There are oil-fired heat exchangers provided with equipment such that the flue gases can give their heat content to the fluid which is to be heated and which conveys the heat to such as radiators in a building. In certain cases, there is thus a pre-heater placed in the flue gas passage for also pre-heating the fluid which distributes the heat. However, this is not a particularly good solution if it is taken into consideration that the flue gases contain substances, which can condense and form coke-like deposits as well as forming corrosive substances which can put great requirements on the material in the heat exchanger and flue gas passage. In addition, such installations will be voluminous.

A desire is therefore to achieve a combustion-driven heat exchanger, in which the heat in the flue gases is recovered to a certain extent and used for heating purposes. Another desire is to achieve a compact and cheap unit, which can easily be connected into the system as required.

The present invention has the object of providing a combustion-driven heat exchanger while mitigating the above-mentioned problems, and which satisfies the mentioned desires. This object is achieved by a structure of the kind disclosed in the claims, which also disclose what is characteristic for the invention.

Figure 1:
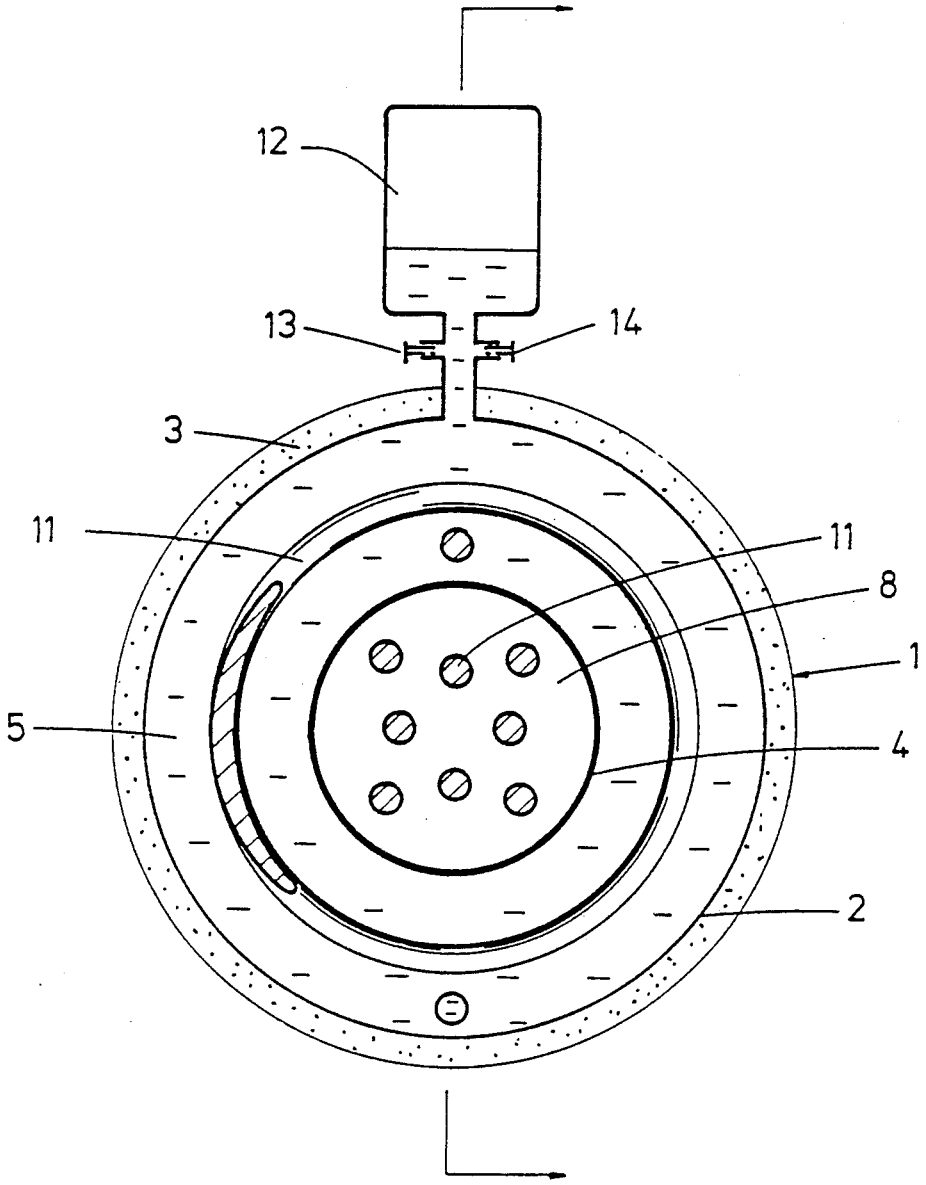
Figure 2:
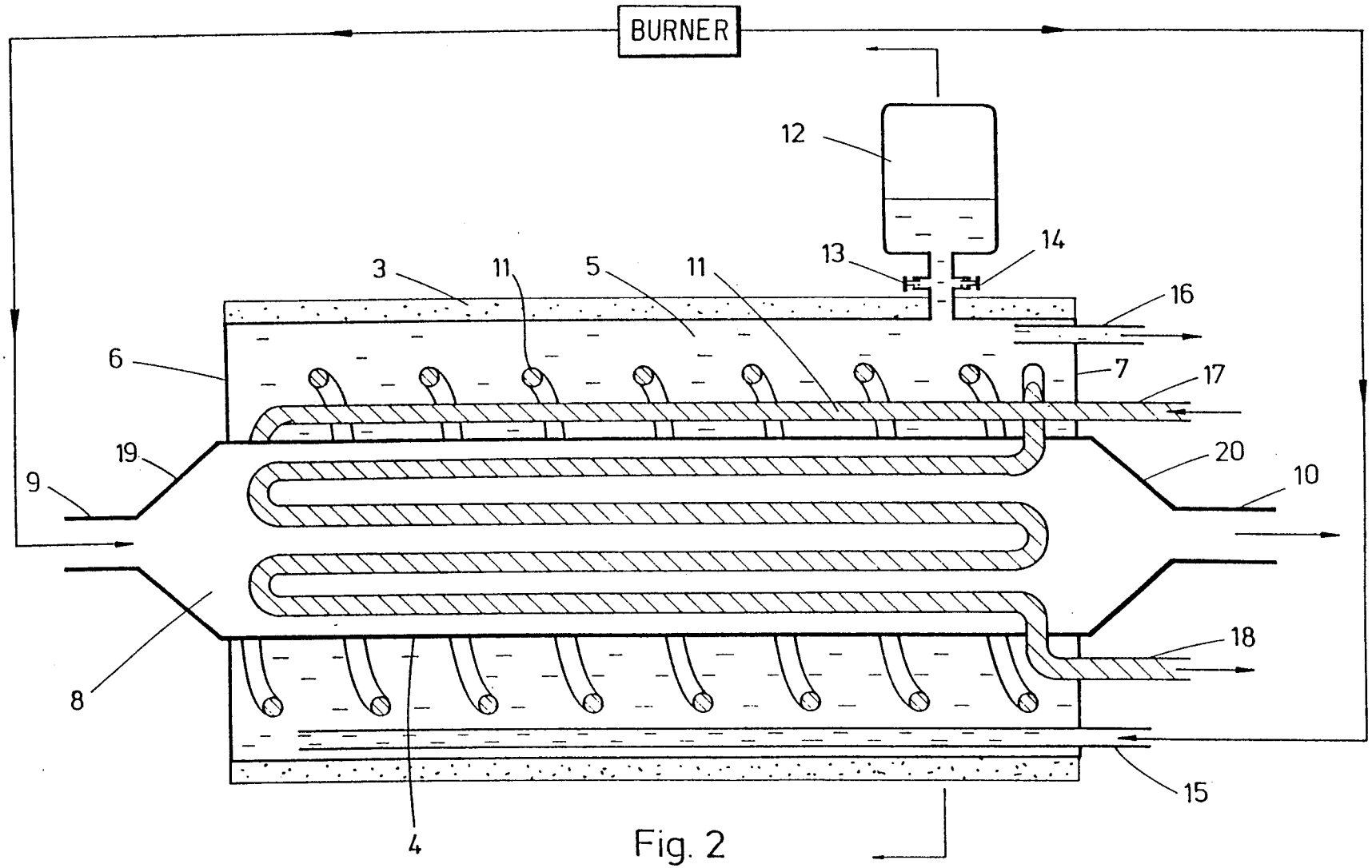

The invention will now be described in more detail in the following in connection with the accompanying drawings, where FIG. 1 is a schematic cross section through a heat exchanger included in a heating apparatus in accordance with the invention, and FIG. 2 is a longitudinal section through the heat exchanger of FIG. 1.

The heat exchanger 1, schematically illustrated in the Figures, is generally tubular in shape, and comprises an exterior shell 2, surrounded by an insulating casing 3, inside of which there is a through-going tube 4, which defines a circular chamber 5 for the primary fluid, i.e. the heating fluid, where the shell 2 constitutes the outer wall and the tube 4 the inner wall, walls 6 and 7 closing off the chamber 5 axially, while the interior of the tube 4 forms a passage 8 for exhaust gases from a burner. The passage 8 is provided with an inlet 9 and an outlet 10, both of which have a lesser diameter than the tube 4 for giving the exhaust gases a decreasing volocity in the through passage 8 compared with that in the inlet 9 and outlet 10.

A pipe 11 for conducting secondary fluid, i.e. the fluid which is to be heated, extends helically through the chamber 5 round the tube 4 and through the tube 4 to the passage 8 for flue gases, where the pipe 11 is extended in several loops going backwards and forwards in the longitudinal direction of the passage 8. An expansion tank 12 is connected to the chamber 5 and is provided with a safety valve 13 for preventing an explosion in the heat exchanger in the case of overheating, the tank also being provided with a venting valve 14.

All fluid connections are placed in the same end wall 7. The connection 15 for incoming primary fluid is arranged at the bottom of the chamber 5 and extends almost up to the opposite end wall 6, where the fluid heated by the burner flows into the chamber 5, and is kept in circulation with the aid of a pump associated with the burner and similarly unillustrated. At the upper part of the chamber, there is an outlet connection 16 for the primary fluid and this extends only as far as a short distance through the end wall 7.

An inlet connection 17 for secondary fluid is placed above the tube 4 and extends towards the opposite end wall 6 where it is helically formed round the tube 4 such as to extend back towards the end wall 7 through which the inlet it passes, and at this end wall the pipe 11 is taken through the tube 4, where it forms the previously mentioned loops for once again being taken through the tube 4 adjacent the end wall 7 to pass out through this wall in the form of the outlet 18.

The tube 4 has an inlet 9 at the end wall 6 and an outlet 10 at the end wall 7. Since the inlet 9 and outlet 10 have considerably less diameter than the tube 4, there are tapering transitions 19, 20 at the junctions between the tube 4 and the inlet 9 and outlet 10. All leads-through and connections are both liquid and gas tight.

An oil burner with at least two power steps is preferably utilized. This burner heats up the primary fluid, which suitably consists of a liquid, e.g. water, which is pumped from the region heated by the burner via the inlet 15 into the chamber 5 where it gives off its heat to the secondary fluid through heat exchange, and returns from the outlet 16 for further heating.

The secondary fluid, e.g. a liquid in a heating system, is pumped through the inlet 17 and through the pipe 11, first through the helix which is placed in the chamber 5, where the secondary fluid is given a first heating, and thereafter through the loops in the passage 8 where it is given further heating before it leaves the heat exchanger.

From the burner, the flue gases, which have a temperature of over 200° C., suitably at least 240° C., flow in through the inlet 9 and into the passage 8, where the flue gases pass over the loops of the pipe 11 in this passage 8 as well as against the inner wall of the tube 4. Heat is thus transferred from the flue gases to both the primary fluid and secondary fluid. The diameter of the passage 8 is adjusted in relation to the diameters of the inlet 9 and outlet 10 such that the flue gases obtain a given residence time in this passage 8 and the exhaust gases flowing out through the outlet 10 thus have a temperature which does not fall below 100° C. This means that he temperature on the inside of the tube 4 as well as the outside of the loops of the pipe 11 in the passage 8 have a temperature of over 100° C. There is thus achieved that the condensation point of the flue gases is below the temperatures which the different parts have, and there are thus no deposits of coke-like substances and corrosive substances on the parts in question. In turn, this results in that cleaning is avoided and that the parts have a long life.

A contributing reason for the heat exchanger actually functioning is that the flue gases are not used for preheating of the secondary fluid, but for post-heating of it after it has been given a first supply of heat through the primary fluid. There is thus achieved that the temperature differences between the combustion gas and the secondary fluid are moderate, and above all sufficiently high for the flue gases to keep the surface temperature of the tube 4 and the loops in the passage 8 about 110° C.

Conventional control equipment is, of course, included in the heating apparatus with a heat exchange in accordance with the invention, for maintaining constant, pre-determined temperatures and different operational controls of the burner and pumps.

The object of mentioned in the introduction has been achieved by the present invention, and a heating apparatus with a heat exchanger has been obtained which is effective, compact and cheap and which requires minor service. One skilled in the art will, however, understand that the invention can be modified in many ways, but such modifications are intended to lie within the scope of the accompanying claims.

We claim:

1. Heating apparatus including a burner connected to a heat exchanger (1), the burner heating a primary fluid which circulates through the heat exchanger (1) to transmit heat of the primary fluid to a secondary fluid in the heat exchanger (1), the heat exchanger (1) being provided with a tube (4) which extends through the heat exchanger and through which exhaust gases from the burner flow, the heat exchanger (1) including a chamber (5) which surrounds the tube (4) and through which the primary fluid flows, as well as a pipe coil (11) through which the secondary fluid flows, the pipe coil (11) being disposed into the chamber (5), around the tube (4), and then through a wall of the tube (4) into a passage (8) within the tube (4), the pipe coil forming one or more loops in the passage (8) and then extending out of the heat exchanger (1), the pipe coil (11) being so disposed so as to lead the secondary fluid first through the primary fluid in the chamber (5) and thereafter through the exhaust gases as the exhaust gases flow through the tube (4), the exhaust gases being led through the passage (8) for heating the wall of the tube (4) as well as said one or more loops.

2. Heating apparatus in accordance with claim 1, wherein the heat exchanger (1) is made as a substantially cylindrical container, through which the tube (4) for the exhaust gases is axially extended.

3. Heating apparatus in accordance with claim wherein the diameter of the passage (8) is greater than an inlet (9) for the exhaust gases entering the passage (8).

4. Heating apparatus in accordance with claim 2 wherein the diameter of the passage (8) is greater than an inlet (9) for the exhaust gases entering the passage (8).

5. A heating apparatus, comprising:

a heat exchanger including:

an inner fluid chamber having an inlet and an outlet and disposed within a first tubular wall; and an outer fluid chamber having an inlet and an outlet and disposed between said first tubular wall and a second tubular wall which is concentric with said first tubular wall;

a burner attached to said inlet of said inner fluid chamber and to said inlet of siad outer fluid chamber for supplying an exhaust gas to said inner fluid chamber and a primary fluid to said outer fluid chamber, respectively; and a conduit for supplying a secondary fluid to said heat exchanger, said conduit having an inlet, an outlet and a length extending therebetween, said inlet and said outlet being attached to said heat exchanger and said length being disposed within said heat exchanger, said length extending from said inlet of said conduit into said outer fluid chamber, then through said first tubular wall into said inner fluid chamber, and then from said inner fluid chamber to said outlet of said conduit.

6. The heating apparatus of claim 5 wherein said length includes a first length which extends from said inlet of said conduit, then is coiled around said first tubular wall and then extends through said first tubular wall into said inner fluid chamber, and a second length which forms one or more loops within said inner fluid chamber, then extends back through said first tubular wall into said outer fluid chamber and then extends to said outlet of said conduit.

7. Heating apparatus in accordance with claim 6, wherein the heat exchanger is made as a substantially cylindrical container, through which the tube for the exhaust gases is axially extended.

8. Heating apparatus in accordance with claim 7 wherein the diameter of the inner fluid chamber is greater than an inlet for the exhaust gases entering the inner fluid chamber.

* * * * *